US006796849B2

(12) United States Patent
Villain

(10) Patent No.: US 6,796,849 B2
(45) Date of Patent: Sep. 28, 2004

(54) ELECTRICAL CONNECTION DEVICE

(75) Inventor: Jean-Christophe Villain, Ounans (FR)

(73) Assignee: Alcatel, Paris (FR)

( * ) Notice: Subject to any disclaimer, the term of this patent is extended or adjusted under 35 U.S.C. 154(b) by 43 days.

(21) Appl. No.: 10/612,983

(22) Filed: Jul. 7, 2003

(65) Prior Publication Data

US 2004/0053538 A1 Mar. 18, 2004

(30) Foreign Application Priority Data

Jul. 8, 2002 (FR) ..... 02 08545

(51) Int. Cl.[7] ..... H01R 13/24

(52) U.S. Cl. ..... 439/700; 439/482; 439/513; 439/218; 439/79

(58) Field of Search ..... 439/79, 513, 700, 439/482, 218

(56) References Cited

U.S. PATENT DOCUMENTS 5,967,856 A * 10/1999 Meller ..... 439/700
5,993,231 A * 11/1999 Hoolhorst ..... 439/218
6,227,872 B1 * 5/2001 Stephenson et al. ..... 439/76.1
6,402,567 B1 * 6/2002 Zhu ..... 439/700
6,431,883 B2 * 8/2002 Pan ..... 439/79
6,509,659 B1 * 1/2003 Carroll et al. ..... 307/125

FOREIGN PATENT DOCUMENTS

WO WO 96/28865 A1 9/1996

* cited by examiner

*Primary Examiner*—Truc Nguyen
(74) *Attorney, Agent, or Firm*—Sughrue Mion, PLLC

(57) ABSTRACT

A fixed electrical connection member of an electronic device for connecting one or more electrical conductors of the electronic device to a mobile electrical connection member external to the electronic device includes, on the side external to the electronic device, 2N conductive terminals disposed on a front face and connected, inside the electronic device, to the electrical conductor of the electronic device, and aligned in pairs. The N pairs are aligned to form two rows of N terminals that are symmetrical with respect to a longitudinal axis. Each terminal of a pair is electrically connected to the terminal of the adjacent pair on the other side of the longitudinal axis.

12 Claims, 2 Drawing Sheets

ELECTRICAL CONNECTION DEVICE

CROSS-REFERENCE TO RELATED APPLICATIONS

This application is based on French Patent Application No. 02 08 545 filed Jul. 8, 2002, the disclosure of which is hereby incorporated by reference thereto in its entirety, and the priority of which is hereby claimed under 35 U.S.C. §119.

BACKGROUND OF THE INVENTION

1. Field of the Invention

The invention relates to electrical connection devices which are used to connect electrically two electrical or electronic devices, for example a mobile telephone and a battery charger or an earpiece.

2. Description of the Prior Art

Using for this kind of electrical connection devices known as "jacks" which take the form of a socket, generally of circular section, into the opening in which a circular section plug is inserted, is known in the art. The socket is carried by the device and the plug constitutes the end of a multiconductor cable.

Depending on the number of conductors to be connected, the socket and the plug each have the commensurate number of conductive portions in the lengthwise direction separated by insulative portions, the corresponding conductive portions of the socket and the plug cooperating to make the electrical contact between them.

These "jack" type electrical connection devices have the following drawbacks:

- they are limited in terms of the number of conductors to be interconnected,
- they have a large overall length, which increases with the number of conductors to be connected,
- they break easily if the plug is pulled out, even if it has a right-angle shape,
- the opening of the socket and the socket itself can become soiled, for example by dust and grains of sand, which leads to poor electrical contact, which can lead to a fault because of destruction of the conductive parts,
- since a distinction between the various cables to be connected to the device relies on the diameter of the plug and therefore of the socket, it can happen that a plug is forced into a socket of slightly smaller diameter, causing damage leading to a fault.

An object of the present invention is therefore to provide an electrical connection device between a cable and an electrical/electronic device that does not have the drawbacks of the prior art electrical connection devices, in particular those of the "jack" type set out hereinabove.

The above object is achieved by providing an electrical connection device in two parts, of which one part has conductive terminals electrically connected to conductors to be connected while the other part has spring contacts each cooperating with a conductive terminal and electrically connected to conductors to be connected, the two parts of the electrical connection device being assembled by resilient clipping that maintains pressure between each conductive terminal and the corresponding spring contact.

SUMMARY OF THE INVENTION

The invention more specifically provides a fixed electrical connection member of an electronic device for connecting one or more electrical conductors of said electronic device to a mobile electrical connection member external to said electronic device, which fixed member includes, on the side external to said electronic device, 2N conductive terminals disposed on a front face and connected, inside said electronic device, to a rear face said electrical conductor of said electronic device, and aligned in pairs, said N pairs being aligned to form two rows of N terminals that are symmetrical with respect to a longitudinal axis, and each terminal of a pair being electrically connected to the terminal of the adjacent pair on the other side of said longitudinal axis.

In a preferred embodiment, said electrical terminals are fixed to a front face of a printed circuit board whose rear face electrically connects them to a spring contact adapted to cooperate with a fixed electrical terminal of said electronic device comprising the electrical conductor of said electronic device.

Advantageously, said spring contact of said fixed member has a first end that is mobile to cooperate with said fixed terminal of said electronic device and a second end that is in elastic contact with one or more conductive tracks on the rear face of said printed circuit board.

Preferably, said front face comprises assembly means adapted to cooperate with said mobile electrical connection member.

In this case, said front face comprises assembly means adapted to cooperate with said mobile electrical connection member.

Advantageously, the fixed electrical connection member has a dimension along said longitudinal axis greater than its dimension perpendicular thereto.

The invention also provides a mobile electrical connection member adapted to cooperate with a fixed electrical connection member as defined hereinabove, which mobile electrical connection member comprises:

- N spring contacts adapted to cooperate with N terminals of said fixed member, having a mobile first end adapted to contact said terminals and a fixed second end adapted to be connected to an electrical conductor, and disposed to face a terminal of each of said N pairs of terminals, each contact facing successively a terminal of each row along said longitudinal axis, and
- means for mounting said mobile member on a peripheral portion of said front face of said fixed member to connect said spring contacts to said terminals.

In one embodiment, the mounting means comprise an elastic ring adapted to clip to said groove in said front face of said fixed member.

Advantageously, the mobile electrical connection member has a section identical to that of said fixed member.

The invention also provides an electrical connection device comprising a fixed member and a mobile member as defined hereinabove, said mobile member being adapted to fit onto said front face of said fixed member.

The connection device according to the invention provides a stable electrical connection. Thus in an audio application the sound transmitted is not subjected to interference and in a data application there is no degradation of the data.

Thanks to the invention, an excellent compromise is obtained between a good electrical connection and easy assembly, by pressure alone, and in two positions of the mobile member, which is particularly advantageous in automobile type situations.

The invention finally provides an electronic device comprising a fixed member of the above kind.

Other features and advantages of the present invention will become apparent on reading the following description of one particular embodiment, which description is given with reference to the accompanying drawings.

DETAILED DESCRIPTION OF THE PREFERRED EMBODIMENT

Figure 1:
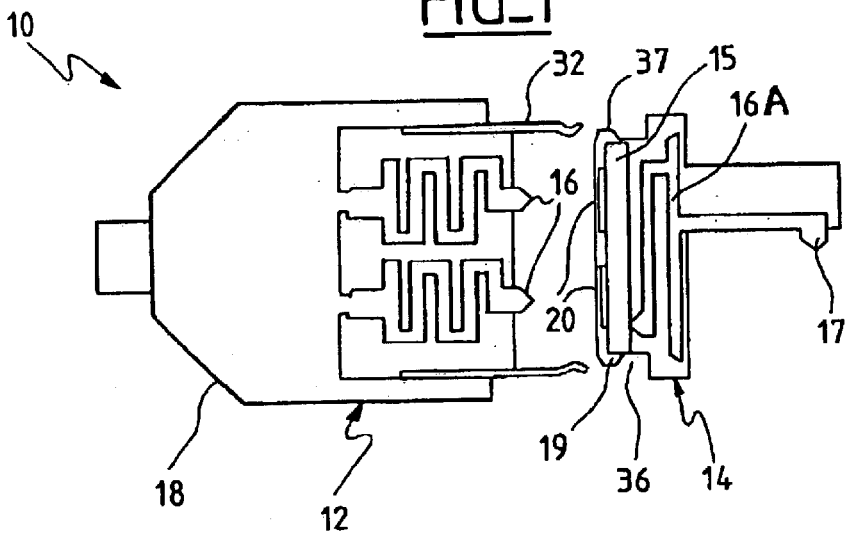
FIG. 1 is a view in cross section of an electrical connection device according to the invention.

As shown in FIG. 1, an electrical connection device 10 according to the invention comprises two separate parts or members 12 and 14 which are assembled by resilient clipping, for example.

The part 12, which is connected to a cable (not shown) with n conductors comprises five spring contacts 16 accommodated in a straight or right-angle shape plug 18 and whose arrangement is explained later. The spring contacts 16 have a mobile first end adapted to contact terminals 20 of the fixed member 14 and a fixed second end adapted to be connected to an electrical conductor.

The plug 18 is made of an insulative material, for example a rigid plastics material. It has an elongate, for example oblong section. The internal construction of the member 12 is conventional and known in the art, and is not described in detail.

The mobile connection member 12 includes means for mounting said mobile member on the peripheral portion of the front face of the fixed member 14 to connect said spring contact 16 to the terminal 20. The mounting means comprise an elastic ring 32 adapted to clip into a groove 36 on the front face of the fixed member 14.

The plug is therefore extended in the lengthwise direction by the circular section ring 32 whose resilient end clips into the circular groove 36 in the part 14.

The ring 32 is preferably made of an electrically conductive metal and can have a plurality of slots at its exterior periphery, enhancing its elasticity for clipping onto the part 14. The fact that the ring 32 is conductive is exploited to detect the electrical connection between the two parts of the connection device and/or to provide an additional electrical connection, for example a ground connection.

However, in some applications the ring 32 can be made of an insulative material like the plug 18, and in this case constitute an integral part of the latter, and feature slots for enhanced clipping elasticity.

The part 14, which is connected to electronic circuits of the device to be connected to the cable, has a generally circular cylindrical shape and features the circular groove 36. To be more precise, it has an elongate, for example oblong section corresponding to the section of the plug 18.

Figure 2:
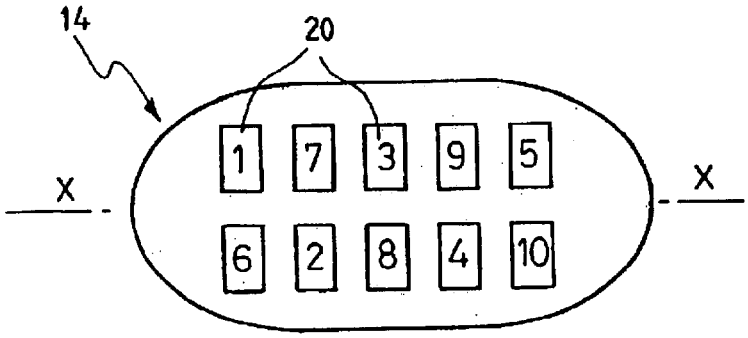
FIG. 2 is a front view of a fixed electrical connection member of this device.

As can be seen clearly in FIG. 2, the fixing member 14 comprises, on the side external to the electronic device, ten conductive terminals 1 to 10 disposed on a front face, said conductive terminals being connected, in the interior of the electronic device, to a rear face said electrical conductor of the electronic device, these ten terminals being aligned in pairs 1 and 6, 7 and 2, 3 and 8, 9 and 4, 5 and 10, and the five pairs being aligned to form two rows of five terminals that are symmetric with respect to a longitudinal axis, namely a first row comprising terminals 1, 7, 3, 9, 5 and a second row comprising terminals 5, 2, 8, 4, 10. Each terminal 20 of a pair is electrically connected to the terminal of the adjacent pair on the other side of the longitudinal axis (x—x). To be more precise, the terminals 1 to 5 are electrically connected to each other, preferably in series. Likewise the terminals 6 to 10.

Referring again to FIG. 1, the electrical terminals are fixed to a front face of a printed circuit board 15 whose rear face electrically connects them to a spring contact 16A adapted to cooperate with a fixed electrical terminal (not shown) of the electronic device comprising the electrical conductor of the electronic device.

The spring contact 16A of the fixed member has a first end 17 that is mobile to cooperate with said fixed terminal of the electronic device and a second end 19 which is in elastic contact with one or more conductive tracks on the rear face of said printed circuit board 15. The electrical connection between these conductive tracks and each of the terminals is made in a manner that is known in the art by connecting conductors passing through holes in the board 15.

The front face of the fixed member 14 comprises assembly means adapted to cooperate with the mobile electrical connection member, in the form of the groove 36 in the vicinity of the front face of the fixed member and a metal plate 37 crimped in the groove 36.

Figure 3:
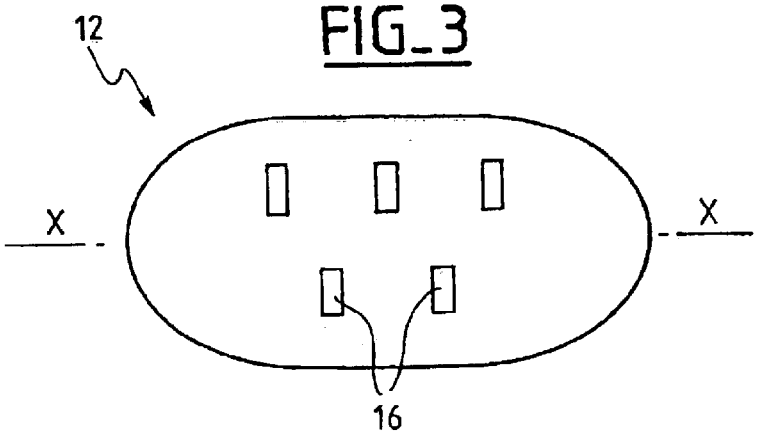
FIG. 3 is a front view of a mobile electrical connection member of this device.

As shown in FIG. 3, the mobile electrical connection member 12 comprises five spring contacts 16 to cooperate with five terminals of the fixed member 14, the five contacts 16 being disposed facing a terminal of each of the five pairs of terminals, each contact successively facing a terminal of each row along the longitudinal axis x—x.

In other words, the spring contacts 16 are offset in two rows corresponding to only one terminal in two in each row.

Figure 4:
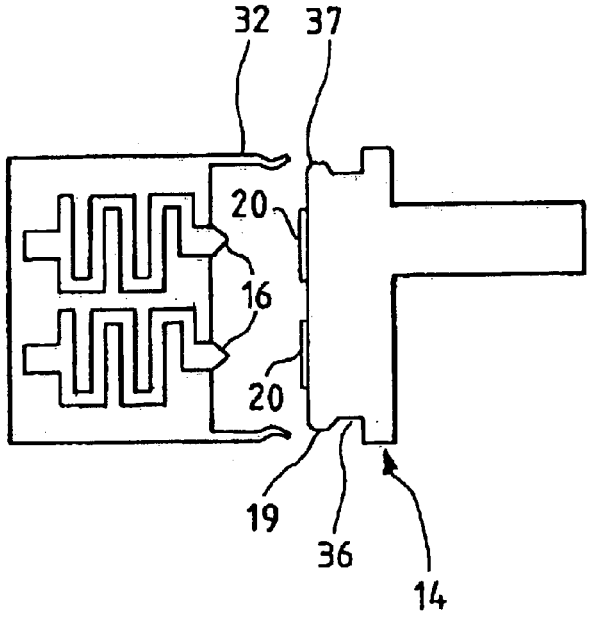
FIG. 4 is a partial view in cross section of an electrical connection device in accordance with the invention in a non-assembled configuration.
Figure 5:
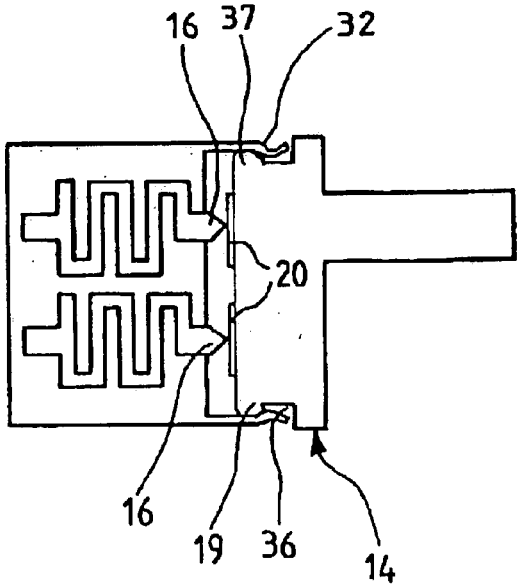
FIG. 5 is a partial view in cross section of an electrical connection device according to the invention in an assembled position.

Assembly is effected as shown in FIGS. 4 and 5. The ring 3 guides the facing members 12 and 14 and its resilient end clips into the circular groove 36 on the part 14. This connects the five spring contacts 16 and the corresponding five terminals 20.

The mobile member 12 can therefore be assembled to the mobile member 14 either of two ways round, i.e. in either of two positions at 180° to each other. In the first position, the five spring contacts 16 come into electrical contact with a series of five terminals 1, 2, 3, 4, 5, and in the second position they come into electrical contact with another series of five terminals 6, 7, 8, 9, 10. The oblong, or more generally elongate section of the two members 12, 14 provides a depolarizer function in respect of these two positions.

The connecting device according to the invention has the following advantages:

- there is no possibility of forcibly connecting two parts 12 and 14 that are not designed to be connected to each other, since the diametral dimensions differ according to the type of cable to be connected,
- if pulled out, the part 12 disconnects easily without damaging the part 14 because of the elasticity of the ring 32,
- wear of the contacts and terminals by successive connection and disconnection is minimized because there is no sliding of one part relative to another, the probability of soiling of the contacts is reduced by the absence of a socket and, should soiling occur, it is easy to clean the contacts, the possibility of ingress of water is limited because there is no socket, the number of conductors to be interconnected can be increased by increasing the number of conductive terminals and the diametral dimension.

The invention applies to any electrical device and in particular to mobile telephones.

What is claimed is:

1. A fixed electrical connection member of an electronic device for connecting one or more electrical conductors of said electronic device to a mobile electrical connection member external to said electronic device, which fixed member includes, on the side external to said electronic device, 2N conductive terminals disposed on a front face and connected, inside said electronic device, to said electrical conductor of said electronic device, and aligned in pairs, said N pairs being aligned to form two rows of N terminals that are symmetrical with respect to a longitudinal axis, and each terminal of a pair being electrically connected to the terminal of the adjacent pair on the other side of said longitudinal axis.

2. The fixed electrical connection member claimed in claim 1 wherein said electrical terminals are fixed to a front face of a printed circuit board whose rear face electrically connects them to a spring contact adapted to cooperate with a fixed electrical terminal of said electronic device comprising the electrical conductor of said electronic device.

3. The fixed electrical connection member claimed in claim 2 wherein said spring contact of said fixed member has a first end that is mobile to cooperate with said fixed terminal of said electronic device and a second end that is in elastic contact with one or more conductive tracks on the rear face of said printed circuit board.

4. The fixed electrical connection member claimed in claim 1, wherein said front face comprises assembly means adapted to cooperate with said mobile electrical connection member.

5. The fixed electrical connection member claimed in claim 4 wherein said assembly means comprise a groove in the vicinity of said front face of said fixed member and a metal plate crimped to said groove.

6. The fixed electrical connection member claimed in claim 1 having a dimension along said longitudinal axis greater than its dimension perpendicular thereto.

7. A mobile electrical connection member adapted to cooperate with a fixed electrical connection member as claimed in claim 1, which mobile electrical connection member comprises:

N spring contacts adapted to cooperate with N terminals of said fixed member, having a mobile first end adapted to contact said terminals and a fixed second end adapted to be connected to an electrical conductor, and disposed to face a terminal of each of said N pairs of terminals, each contact facing successively a terminal of each row along said longitudinal axis, and means for mounting said mobile member on a peripheral portion of said front face of said fixed member to connect said spring contacts to said terminals.

8. The mobile electrical connection member claimed in claim 7 wherein said mounting means comprise an elastic ring adapted to clip to said groove in said front face of said fixed member.

9. The mobile electrical connection member claimed in claim 7, whose section is identical to that of said fixed member.

10. An electrical connection device comprising a fixed member as claimed in claim, 1 and a mobile member, said mobile member being adapted to fit onto said front face of said fixed member.

11. An electronic device comprising a fixed electrical connection member of an electronic device for connecting one or more electrical conductors of said electronic device to a mobile electrical connection member external of said electronic device, said fixed electrical connection member comprising externally of said electronic device, 2N conductive terminals disposed on a front face, connected inside said electronic device to said electrical conductor of said electronic device, and aligned in pairs, said N pairs being aligned to form two rows of N terminals that are symmetrical with respect to a longitudinal axis, and each terminal of a pair being electrically connected to the terminal of the adjacent pair on the other side of said longitudinal axis.

12. An electrical connection device comprising a mobile member as claimed in claim 7, said mobile member being adapted to fit onto said front face of said fixed member.

* * * * *